US008821612B2

(12) United States Patent
Haidar et al.

(10) Patent No.: US 8,821,612 B2
(45) Date of Patent: Sep. 2, 2014

(54) APPARATUS AND METHODS FOR THE PRODUCTION OF METAL COMPOUNDS

(75) Inventors: Jawad Haidar, Carlton (AU); Sabaratnasingam Gnanarajan, Toongabble (AU); John Burton Dunlop, Davidson (AU)

(73) Assignee: Commonwealth Scientific and Industrial Research Organisation, Campbell Act (AU)

( * ) Notice: Subject to any disclaimer, the term of this patent is extended or adjusted under 35 U.S.C. 154(b) by 492 days.

(21) Appl. No.: 12/225,552

(22) PCT Filed: Mar. 27, 2007

(86) PCT No.: PCT/AU2007/000385

§ 371 (c)(1),
(2), (4) Date: Jan. 9, 2009

(87) PCT Pub. No.: WO2007/109847

PCT Pub. Date: Oct. 4, 2007

(65) Prior Publication Data

US 2009/0165597 A1 Jul. 2, 2009

(30) Foreign Application Priority Data

Mar. 27, 2006 (AU) ..... 2006901558

(51) Int. Cl.
*C22B 34/12* (2006.01)
*C21C 5/38* (2006.01)

(52) U.S. Cl.
USPC ..... 75/620; 75/10.21

(58) Field of Classification Search
CPC ..... B22F 9/28; C22B 5/04; C22B 5/18; C22B 34/1272; C22B 34/1277; C22C 14/00; C22C 1/0491
USPC ..... 75/620, 10.21
See application file for complete search history.

(56) References Cited

U.S. PATENT DOCUMENTS 2,745,735 A 5/1956 Byrns
3,004,848 A 1/1961 Hansley et al.

(Continued)

FOREIGN PATENT DOCUMENTS

DE 27 47 016 4/1978
DE 2747016 4/1978

(Continued)

OTHER PUBLICATIONS

A.B. Murphy et al., "Equilibrium Calculation of the Reduction of Titanium Tetrachloride by Aluminum and Hydrogen", High Temp. Chem. Processes 3, Aug. 1994, pp. 365-374.

(Continued)

*Primary Examiner* — Rebecca Lee
(74) *Attorney, Agent, or Firm* — Neifeld IP Law

(57) ABSTRACT

The present invention relates to a stepwise method for the production of titanium-aluminum compounds and some titanium alloys and titanium-aluminum inter-metallic compounds and alloys. In a first step an amount of aluminum is mixed with an amount of aluminum chloride (AlCl3) and then an amount of titanium chloride (TiCl4) is added to the mixture. The mixture is heated to a temperature of less than 220° C. to form a product of TiCl3, aluminum and AlCl3. In a second step, more aluminum can be added if required, and the mixture heated again to a temperature above 900° C. to form titanium-aluminum compounds. This method results in the production of powdered forms of titanium-aluminum compounds with controllable composition. Suitable reactor apparatus is also described.

10 Claims, 7 Drawing Sheets

A schematic diagram showing the various steps of the process.

(56) References Cited

U.S. PATENT DOCUMENTS

| | | | |
|---|---|---|---|
| 3,252,823 | A | 5/1966 | Jacobson et al. |
| 3,301,665 | A | 1/1967 | Timm et al. |
| 3,450,525 | A | 6/1969 | Van Den Steen |
| 3,455,678 | A | 7/1969 | Shapiro et al. |
| 3,684,264 | A | 8/1972 | Petrov et al. |
| 3,900,312 | A | 8/1975 | Terry et al. |
| 4,437,888 | A | 3/1984 | Jecker |
| 4,447,045 | A | 5/1984 | Kimura et al. |
| 4,508,322 | A | 4/1985 | Kimura et al. |
| 4,877,445 | A | 10/1989 | Okudaira et al. |
| 4,902,341 | A | 2/1990 | Okudaira et al. |
| 5,032,176 | A | 7/1991 | Kametani et al. |
| 5,397,375 | A | 3/1995 | O'Donnell et al. |
| 5,460,642 | A | 10/1995 | Leland |
| 5,935,293 | A | 8/1999 | Detering et al. |
| 2002/0184971 | A1 | 12/2002 | Myrick |
| 2004/0050208 | A1 | 3/2004 | Nie et al. |
| 2006/0191372 | A1 | 8/2006 | Haidar |
| 2009/0165597 | A1 | 7/2009 | Haidar et al. |
| 2011/0091350 | A1 | 4/2011 | Haidar |

FOREIGN PATENT DOCUMENTS

| | | |
|---|---|---|
| EP | 0 097 135 | 12/1983 |
| EP | 0097135 | 12/1983 |
| EP | 0 134 643 | 6/1984 |
| EP | 0134643 | 6/1984 |
| EP | 0 298 698 | 1/1989 |
| EP | 0298698 | 1/1989 |
| GB | 754869 | 8/1956 |
| GB | 757873 | 9/1956 |
| GB | 1 516 257 | 6/1978 |
| GB | 1516257 | 6/1978 |
| GB | 1 566 363 | 4/1980 |
| GB | 1566363 | 4/1980 |
| GB | 2 158 102 | 11/1985 |
| GB | 2158102 | 11/1985 |
| JP | 52-32988 | 3/1977 |
| JP | 52-078608 | 7/1977 |
| JP | 64-15334 | 1/1989 |
| JP | 4-107234 | 4/1992 |
| JP | 2001192711 | 7/2001 |
| RU | 2 082 561 | 6/1997 |
| RU | 2082561 | 6/1997 |
| UA | 38454 | 5/2001 |
| UA | 38454 A | 6/2001 |
| UA | 38454 A | 6/2001 |
| WO | 92/14851 | 9/1992 |
| WO | WO92/14851 | 9/1992 |
| WO | 2005/002766 | 1/2005 |
| WO | WO 2005/002766 | 1/2005 |
| WO | 2007/109847 | 10/2007 |
| WO | WO 2007/109847 | 10/2007 |

OTHER PUBLICATIONS

D. Hu, "Effect of boron addition on tensile ductility in lamellar TiAl alloys", Intermetallics 10, 2002, pp. 851-858.

Toru H. Okabe et al., "Reaction Pathways during Metallothermic Reduction of $TiCl_4$ by Utilizing Chemical Potential Diagrams", Titanium Extracting and Processing, 1997, pp. 133-151.

Carroll W. DeKock et al., "Attempted Preparation of Ti-6-4 Alloy Powders from $TiCl_4$, Al, $VCl_4$ and Na", Metallurgical Transactions B, vol. 18B, Sep. 1987, pp. 511-517.

R.W. Bartlett et al., "Titanium Powder by Magnesium Reduction of $TiCl_4$ in Liquid Zinc Alloy", Light Metals, 1994, pp. 1181-1186.

L. Lu et al., "The Mechanical Alloying of Titanium Aluminides", JOM, Feb. 2002, pp. 62-64.

N. Bertolino et al., "Ignition mechanism in combustion synthesis of Ti-Al and Ti-Ni systems", Intermetallics 11, 2003, pp. 41-49.

S.J. Gerdemann et al., "Titanium Aluminide Powder Production Via Reaction Between $TiCl_4$ and Al", Gamma Titanium Aluminides, 1999, pp. 341-346.

George Zheng Chen et al., "Direct electrochemical reduction of titanium dioxide to titanium in molten calcium chloride", Nature, vol. 407, Sep. 2000, pp. 361-364.

R.G. Reddy et al., "Thermodynamic properties of Ti-Al intermetallics", Journal of Alloys and Compounds 321, 2001, pp. 223-227.

U.S. Appl. No. 10/560,804, Jawad Haidar, Dec. 15, 2005.

International Search Report for PCT/AU2007/000385, mailed May 21, 2007.

International Preliminary Report on Patentability for PCT/AU2007/000385, dated Feb. 8, 2008.

Supplementary European Search Report for copending European Application EP 07 71 8632, completed Mar. 25, 2010, 1 page.

English Translation of Official Decision on Grant in corresponding Ukrainian Application No. a 2008 12511, issued May 14, 2010, 2 pages.

T. Uda et al., "Contactless Electrochemical Reduction of Titanium (II) Chloride by Aluminum", Metalluroical and Materials Transactions B, vol. 31B, Aug. 2000—pp. 713-721.

ESR Application No./Patent No. 04737520.9-1215.

May 21, 2007, ISR for PCT/AU2007/000385.

Feb. 8, 2008, IPER for PCT/AU2007/000385.

Jun. 19, 2009, ISR for PCT/AU2009/000501.

Jun. 23, 2011, ISR for PCT/AU2010/001697.

Supplementary ESR for copending European Application EP 07718632, completed Mar. 25, 2010.

English Translation of Official Decision on Grant in corresponding Ukrainian Application No. 2008 12511, issued May 14, 2010.

Bartlett et al., "Titanium Powder by Magnesium Reduction of TiCl in Liquid Zinc Alloy," Light Metals, 1994, pp. 1181-1186.

Bertolino, et al. "Ignition mechanism in combustion synthesis of T—Al and Ti—Ni systems," Intermetallics 11, 2003, pp. 41-49.

Chen et al. "Direct electrochemical reduction of titanium dioxide to titanium in molten calcium chloride," Nature, vol. 407, Sep. 2000, pp. 361-364.

DeKock et al., "Attempted Preparation of Ti-6-4 Alloy Powders from $TiCl_4$, Al, $VCl_4$ and Na," Metallurgical Transactions B, vol. 18B, Sep. 1987, pp. 511-517.

Gerdemann et al. "Titanium Aluminicide Powder Reduction Via Reaction Between $TiCl_4$ and Al," Gamma Titanium Aluminides, 1999, pp. 341-346.

D. Hu; "Effect of boron addition on tensile ductility in lamellar TiAl alloys", Intermetallics 10 (2002) pp. 851-858.

Lu, et al. "The mechanical Alloying of Titanium Aluminides," JOM, Feb. 2002, pp. 62-64.

Murphy et al. "Equilibrium Calculation of the Reduction of Titanium Tetrachloride by Aluminum and Hydrogen" High Temp. Chem. Processes 3, Aug. 1994, pp. 365-374.

Okabe et al., "Reaction Pathways during Metallothermic Reduction of $TiCl_4$ by Utilizing Chemical Potential Diagrams," Titanium Extracting and Processing, 1997, pp. 133-150.

Reddy, et al. "Thermodynamic properties of Ti—Al intermetallics," Journal of Alloys and Compounds 321, 2001, pp. 223-227.

T. Uda et al.; "Contactless Electrochemical Reduction of Titanium (II) Chloride by Aluminum", Metallurgical and Materials Transactions B, vol. 31B, Aug. 2000, pp. 713-721.

Jul. 29, 2004, ISR PCT/AU2004/000899.

U.S. Appl. No. 10/560,804, filed Dec. 15, 2005, Pending.

U.S. Appl. No. 12/988,884, filed Dec. 22, 2010, Pending.

U.S. Appl. No. 13/514,990, filed Jun. 10, 2012, Pending.

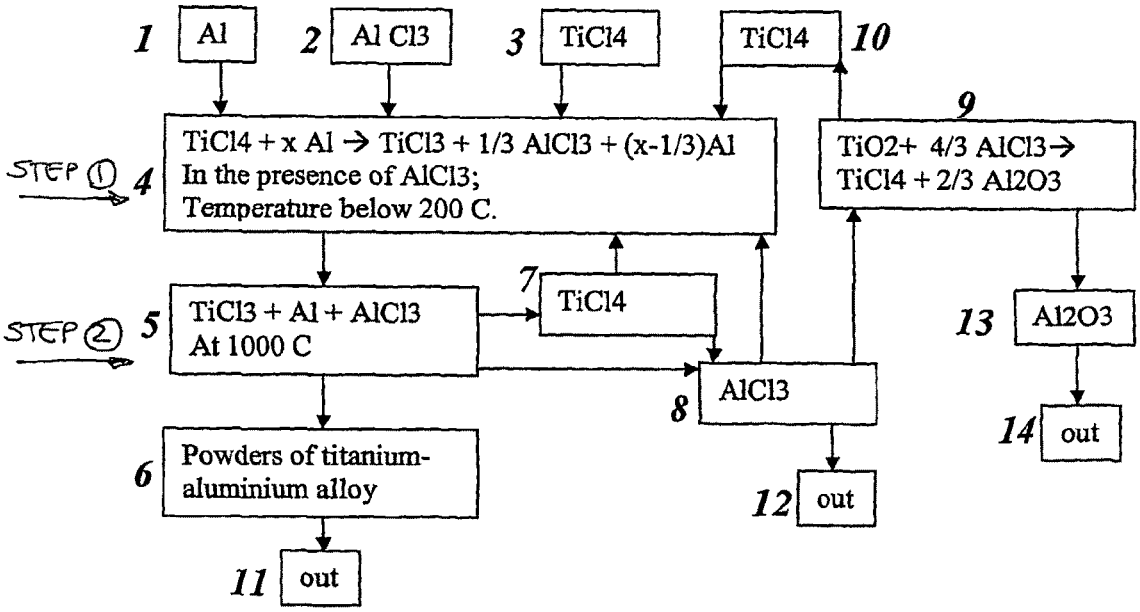
Figure 1: A schematic diagram showing the various steps of the process.

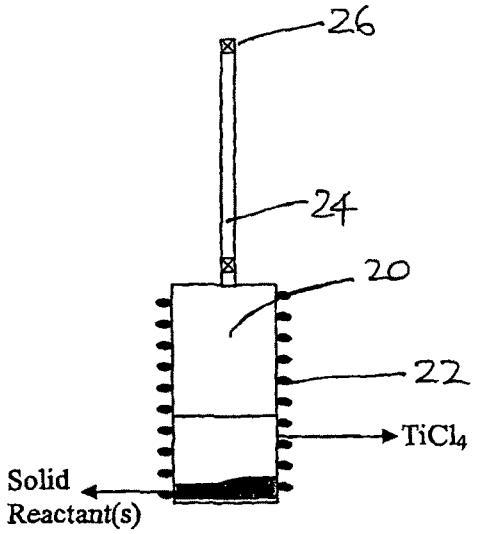
Figure 2: A schematic diagram of a cell for production of $TiCl_3$.

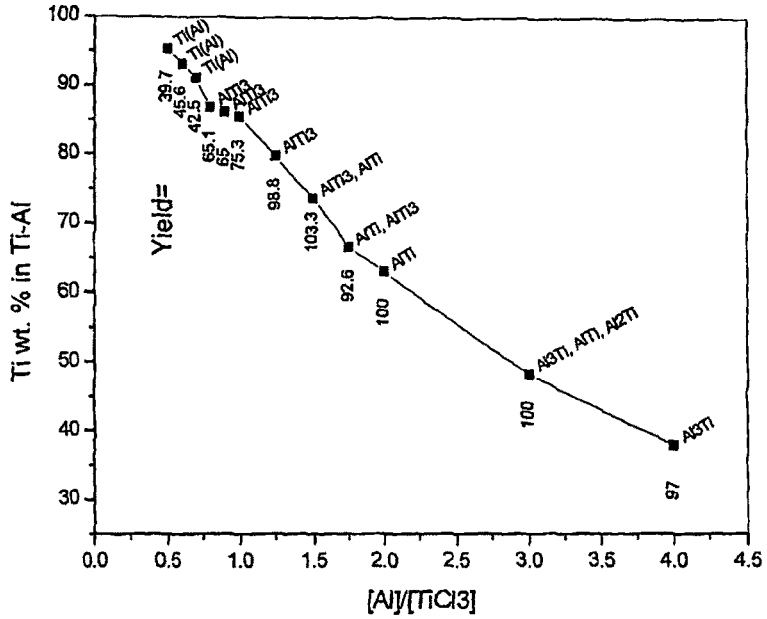
Figure 3: Ti concentration (in weight %) in Ti-Al powders produced using a starting fine Al powder (<15 μm) as a function of the [Al]/[$TiCl_3$] ratio. Also shown are the yields and phases identified in the products.

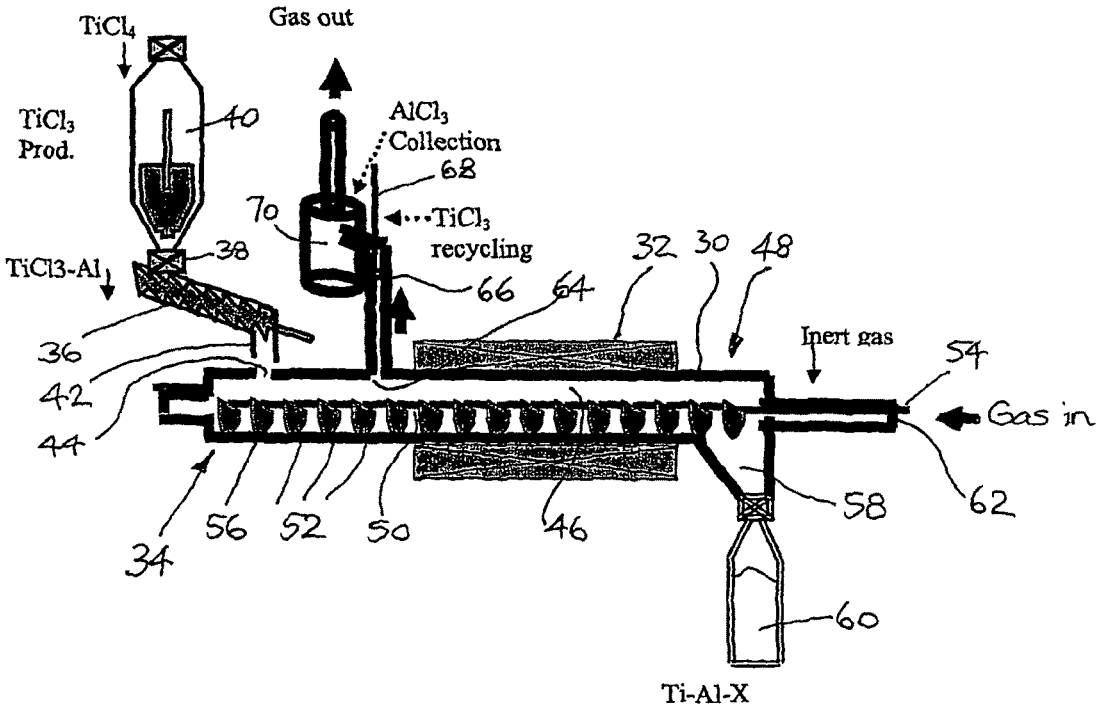
Figure 4: A schematic diagram of the continuous production system.

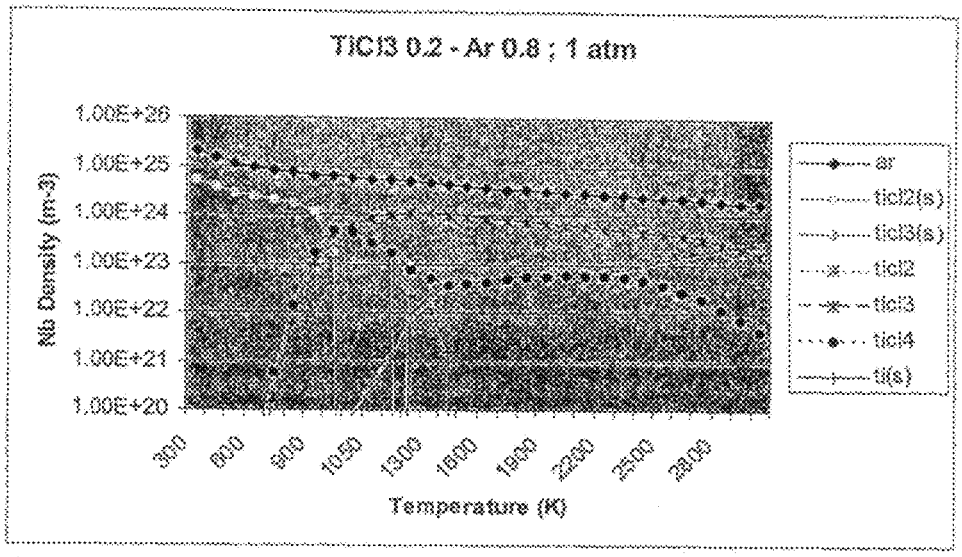
Figure 5: Calculated composition of $TiCl_3$ under argon at 1 atm in a temperature range up to 3000 K.
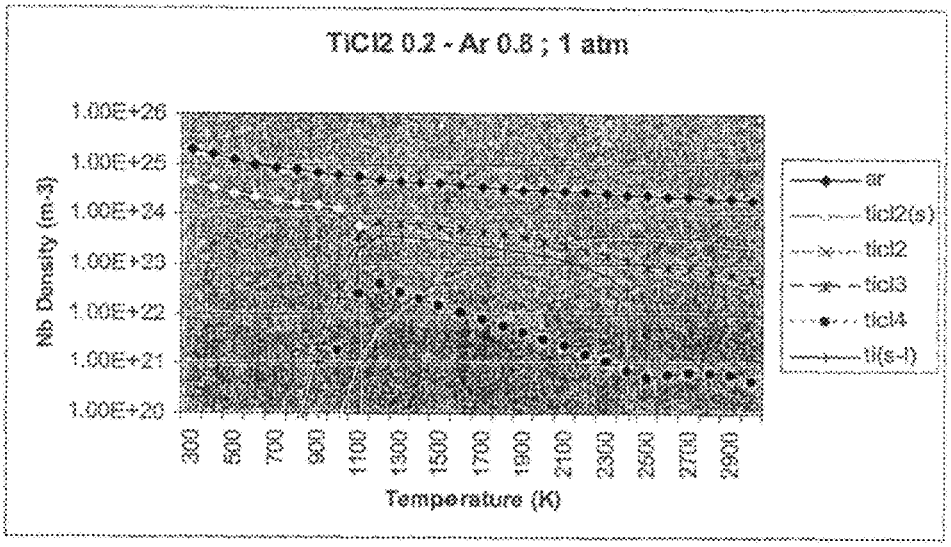
Figure 6: Calculated composition of $TiCl_2$ under argon at 1 atm in a temperature range up to 3000 K.

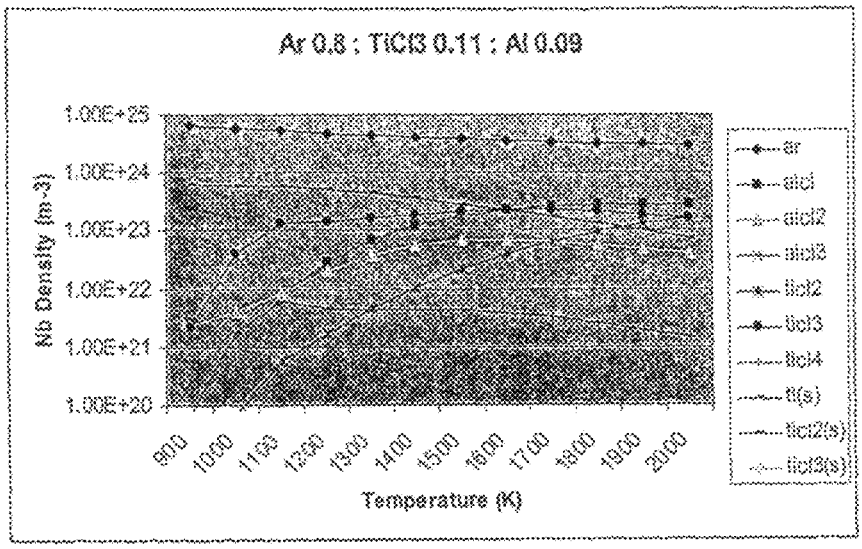
Figure 7: Calculated composition of $TiCl_3$-Al under argon at 1 atm in a temperature range up to 3000 K. $[Al]/[TiCl_3]=0.82$
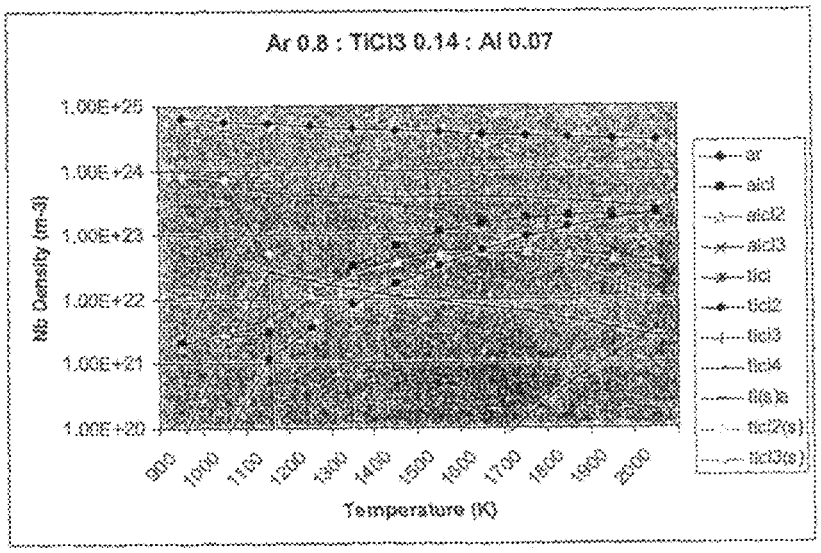
Figure 8: Calculated composition of $TiCl_3$-Al under argon at 1 atm in a temperature range up to 3000 K. $[Al]/[TiCl_3]=0.5$.

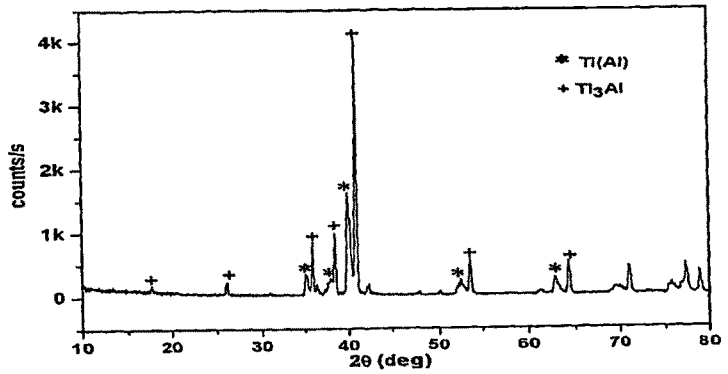
Figure 9-a: XRD spectrum obtained at the start of the run (8.5 wt% Al), starting from 127 ml of TiCl4 and 37.2 g of Al flakes.
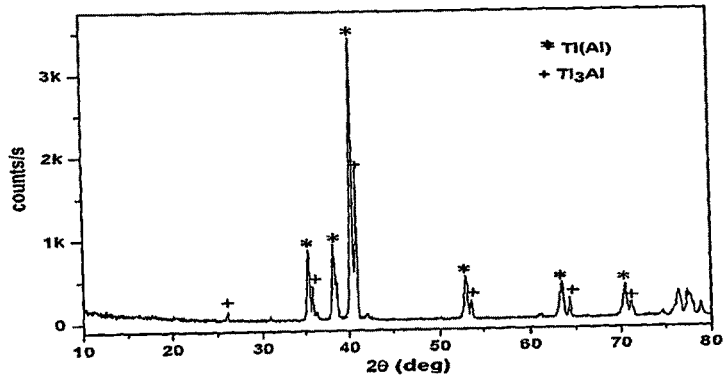
Figure 9-b: XRD spectrum obtained towards mid-time of the run(7 wt% Al), starting from 127 ml of TiCl4 and 37.2 g of Al flakes.
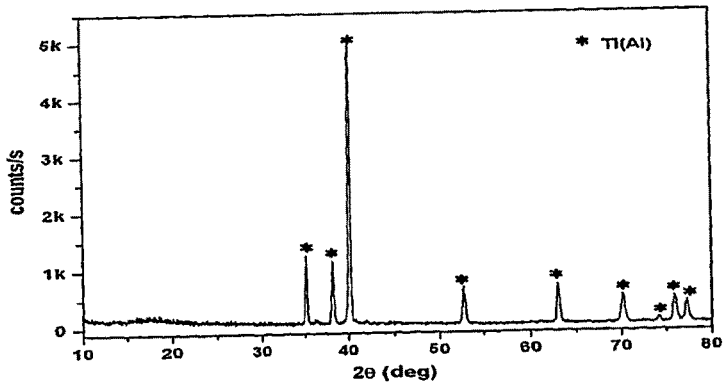
Figure 9-c: XRD spectrum obtained at the end of the run(1.5 wt% Al), starting from 127 ml of TiCl4 and 37.2 g of Al flakes.

APPARATUS AND METHODS FOR THE PRODUCTION OF METAL COMPOUNDS

This application is the U.S. national phase of International Application No. PCT/AU2007/000385, filed 27 Mar. 2007, which designated the U.S. and claims priority to Australia Application No. 2006901558, filed 27 Mar. 2006, the entire contents of each of which are hereby incorporated by reference.

FIELD OF THE INVENTION

The present invention relates to a method and apparatus for the production of metal and metal compounds and, particularly, but not exclusively, to a method and apparatus for production of titanium-based alloys and intermetallic complexes, and more particularly, but not exclusively, to a method and apparatus for the production of titanium-aluminium based alloys and intermetallic complexes.

BACKGROUND OF THE INVENTION

Titanium-aluminium alloys and inter-metallic compounds (generically termed herein "titanium-aluminium compounds") are very valuable materials. However, they are difficult and expensive to prepare, particularly in the preferred powder form. This expense of preparation limits wide use of these materials, even though they have highly desirable properties for use in automotive, aerospace and other industries.

Titanium minerals are found in nature in the form of a very stable oxide ($TiO_2$). Common processes for the production of titanium are the Kroll process and the Hunter process. The Kroll process requires the use of magnesium as a reducing agent to reduce $TiCl_4$ (prepared from the oxide by a pre-process of chlorination) to produce the Ti metal. The Hunter process requires the use of sodium as the reducing agent. Because $TiCl_4$ is still thermodynamically stable, highly reactive reducing agents such as magnesium or sodium are required to produce titanium metal out of $TiCl_4$. Such highly reactive reducing agents are difficult and expensive to handle. As the magnesium chlorides in the case of the Kroll process are stable up to temperatures in excess of 1300K, the product is often in the form of a Ti sponge mixed with $MgCl_2$ and remnants of Mg and $TiCl_2$. To obtain pure Ti, the product requires extensive post-processing, including washing and melting in a vacuum arc furnace to remove all impurities. This contributes to the present high cost of the production of titanium.

In the known technologies for production of titanium alloys such as Ti—Al—V, and intermetallic compounds such as $Ti_3Al$, TiAl, $TiAl_3$, Ti—Al—(Cr, Nb, Mo, etc) and alloys based on these compounds, appropriate amounts of sponges, ingots or powders of the metals which comprise these alloys are milled or melted together and annealed, hence adding to the production cost, particularly as it is necessary to obtain the metals first which, as discussed, in the case of titanium, involves considerable expense. For production of a powder of these titanium alloys and intermetallic compounds, further processing is usually required, adding to the already high production cost.

Over the past several decades, there have been extensive attempts made to replace the existing Kroll and Hunter technologies using techniques such as electrowinning, plasma-hydrogen and also aluminothermic reduction. In attempts to perform direct reduction of $TiCl_4$ with aluminium, an uncontrollable production of product compounds of widely different composition occurs, for instance intermetallic compounds such as $Ti_3Al$, TiAl, $TiAl_3$. Because of the difficulties associated with uncontrollable gas phase reactions it has not been possible to achieve the production of a single phase material of titanium and/or titanium-aluminium compounds by direct reduction of titanium chlorides.

SUMMARY OF THE INVENTION

In accordance with a first aspect, the present invention provides a stepwise method of producing titanium-aluminium compounds, comprising a first step of:

reducing an amount of titanium chloride ($TiCl_4$) with an amount of aluminium at a temperature below 220° C. to trigger reactions to form titanium subchloride(s) and aluminium chloride ($AlCl_3$) products in a first reaction zone;

and then a second step of:

mixing said products, with the addition of more aluminium if required, and heating the mixture in a second reaction zone to a temperature above 900° C. to form $AlCl_3$ in a gas phase, and to produce a reaction end product of the titanium-aluminium compounds.

When the term titanium subchloride is used throughout this specification, it can refer to titanium trichloride $TiCl_3$ and/or titanium dichloride $TiCl_2$ or other combinations of titanium and chloride excluding $TiCl_4$ which is referred to herein as titanium chloride.

When the term titanium compound is used throughout this specification, it can refer to titanium alloys and/or titanium/metal intermetallic compounds. In one preferred form which is referred to herein, the titanium compounds include titanium-aluminium alloys and/or titanium-aluminium intermetallic compounds.

In one embodiment of the method, the first step can be conducted at a temperature below 200° C.

In one embodiment of the method, the first step can be conducted at a temperature below 160° C.

In one embodiment of the method the first step can be conducted at a temperature below 136° C.

In one embodiment of the method the first step can be conducted at a temperature below 60° C.

In one embodiment of the method, the first step can be conducted with an excess amount of aluminium present to reduce all of the titanium chloride ($TiCl_4$) to form said titanium subchloride(s) and aluminium chloride ($AlCl_3$) products.

In one embodiment of the method, titanium subchloride(s) and/or titanium chloride which escape(s) the first reaction zone can be condensed at a temperature different to that in the reaction zone. In one form of this, the method can further comprise the step of returning condensed titanium subchloride(s) and/or titanium chloride to the first reaction zone. In another form, the method may further comprise the step of separately collecting some of the condensed titanium chloride.

In one embodiment of the method, in the first step the aluminium can be mixed with an amount of aluminium chloride ($AlCl_3$) which acts as a catalyst for the reaction between titanium chloride and aluminium.

In one embodiment of the method, the products of the first step, and any additional aluminium if required, can be mixed to the extent that unreacted aluminium is distributed substantially uniformly in the resulting mixture prior to heating the mixture in the second step.

In one embodiment of the method, the second step can be conducted at a temperature above 1000° C.

In one embodiment of the method, the second step can be arranged for removal of the $AlCl_3$ from the second reaction zone to favour a forward reaction to produce the titanium-aluminium compounds. In one form of this, the removal of $AlCl_3$ from the second reaction zone may be continuous. In one arrangement, the $AlCl_3$ may be condensed away from the second reaction zone at a temperature lower than that in the second reaction zone.

In one embodiment of the method, titanium subchloride(s) which escape(s) the second reaction zone can be condensed at a temperature different to that in the second reaction zone. In one form of this, the method may further comprise the step of returning said condensed titanium subchloride(s) to the second reaction zone.

In one embodiment of the method, the second step can be arranged for a generally continuous flow of solid feed reagent(s) and/or solids reaction end product(s) to cross through the second reaction zone.

When the term "generally continuous" is used throughout this specification, it can refer to processes which operate on a continuous or a quasi-continuous (or stepwise) basis in terms of flow or throughput of a material, as distinct from processes which operate on a batch basis, which operate on, and using, a fixed quantity of a material.

In one embodiment of the method, the second step can be arranged for unidirectional movement of solids feed reagent(s) and/or solid reaction end product(s) through the second reaction zone.

In one embodiment of the method, the second step can be arranged for passing a flow of an inert gaseous atmosphere comprising an amount of helium through the second reaction zone so as to increase the thermal conductivity within that reaction zone.

In one embodiment, the method can further comprise the step of recycling at least some of the aluminium chloride formed for use as the catalyst in the first step.

In one embodiment, the method can further comprise the step of recycling at least some of the aluminium chloride formed to produce $TiCl_4$. In one form of this, the aluminium chloride may be used to reduce titanium oxide to produce $TiCl_4$. In another form, aluminium oxide can be produced by reduction of titanium oxide, and the aluminium oxide electrolysed to produce aluminium raw material for use in the method of any one of the preceding claims.

In one embodiment, the method can also comprise the step of introducing a source of one or more elements. In one form of this, the or each element can be selected from the group comprising chromium (Cr), niobium (Nb), vanadium (V), zirconium (Zr), silicon (Si), boron (B), molybdenum (Mo), tantalum (Ta) and carbon (C), and products of said method include titanium-aluminium compounds which include one or more of these elements. In one form, the source of the or each element is added to the titanium chloride and the aluminium prior to or during the reactions in the first reaction zone.

In one form, the source of the element(s) can be a metal halide, a subhalide, a pure element or another compound which includes the element. In one form, the products can also include one or more of an intermetallic compound, a titanium-(selected element)-alloy, and intermediate compounds. The source may also include a source of other precursors containing a required alloy additive, depending upon the required end product.

In one embodiment of the method, the source can include vanadium subchloride (such as vanadium trichloride and/or vanadium dichloride), and a product of said method is an alloy or intermetallic complex including titanium, aluminium and vanadium. In one form of this, the method can comprise the step of adding the source in appropriate proportions, and carrying out the method to produce Ti-6Al-4V.

In one embodiment of the method, the source can include zirconium subchloride, and a product of the method can be an alloy or intermetallic complex including titanium, aluminium, zirconium and vanadium.

In one embodiment of the method, the source can include niobium halide and chromium halide, and a product of said method can be an alloy or intermetallic complex including titanium, aluminium, niobium and chromium. In one form of this, the method can comprise the step of adding the source in appropriate proportions, and carrying out the method to produce Ti-48Al-2Nb-2Cr.

In one embodiment, the aluminium can be added in the form of a powder having an approximate upper grain size of less than about 50 micrometers.

In an alternative embodiment, the aluminium can be in the form of a powder of an approximate upper grain size of greater than about 50 micrometers, and the method can comprise the step of milling the aluminium powder to reduce the grain size of the aluminium powder in at least one dimension. In one form of this, the aluminium powder may be milled in the presence of $AlCl_3$. In another form, the aluminium and titanium chloride may be milled together as part of the first step.

In a further alternative embodiment, the aluminium can be in the form of flakes having a thickness in one dimension of less than about 50 micrometers. The relatively coarser aluminium powder to be ground, or the flakes, can represent a cheaper raw material.

In one embodiment, the method is conducted in an inert gas atmosphere or in a vacuum. The inert gas usually comprises helium or argon, or a combination of such gases.

In one embodiment, the first step of reducing an amount of titanium chloride with an amount of aluminium to form titanium subchloride(s) and aluminium chloride products is at least partly conducted in a mill. Such an arrangement can convey energy in the form of heat to reactively mill the feed materials to reduce their size as well as to trigger reactions to form the products.

The inventors have found that using a stepwise method gives a number of advantages. There are not the problems of different, uncontrollable phases which can happen when starting from titanium tetrachloride as a precursor and trying to directly convert this precursor to a titanium-aluminium compound in one step. Use of the stepwise method means that the composition of the end product is relatively controllable and depends on the ratios of the starting materials. The correct ratios of starting materials are incorporated in the precursor materials to produce the appropriate proportions of components in the product.

The inventors believe that the new method enables a cheaper and more controllable process for the production of titanium-aluminium compounds. It is not necessary to follow known paths of first converting a raw titanium mineral to titanium metal, for example. Titanium oxide mineral can be chlorinated using conventional technology to give titanium tetrachloride. Using the present invention, this material can then firstly be reduced using aluminium (or another reductant) to give titanium subchlorides (mainly titanium trichloride), which can then, in turn, be used for the formation of the titanium-aluminium compounds.

Using the present invention, is possible to form Ti-6Al-4V, which is one of the major titanium alloys used. It is also possible to form Ti-48Al-2Nb-2Cr. It is also possible to form other alloys such as Ti—Al—Nb—C, and $Ti_3Al$ based alloys.

It is also possible to produce titanium-aluminium compounds with a very low aluminium content (down to fractions of a percentage by weight). The stepwise method of the present invention also has the advantage that alloy powder can be produced directly, with no further physical processing required.

In accordance with a second aspect, the present invention provides a method for production of a powder of titanium-aluminium intermetallic compounds and alloys based on titanium-aluminium intermetallics as defined in the first aspect, wherein starting materials for the method include aluminium powder and titanium chloride.

In accordance with a third aspect, the present invention provides a method of producing a metal compound, comprising the steps of:

heating metal subhalide(s) and aluminium in a reaction zone to a temperature sufficient for the metal halide or subhalide to react with the aluminium to form the metal compound and aluminium halide;

condensing metal halide or subhalide which escapes the reaction zone in a condensation zone operated at a temperature which is between the temperature in the reaction zone and a temperature at which aluminium halide also escaping the reaction zone will condense; and returning only said condensed metal halide or subhalide from the condensation zone to the reaction zone.

In one embodiment, the reaction zone can operate at a temperature above 900° C.

In one embodiment, the condensation zone can operate at a temperature of between 250° C. and 900° C.

In one embodiment, the method can further comprise the step of separately condensing gaseous aluminium halide which escapes the reaction zone at a temperature lower than the temperature in the condensation zone. In one form of this, the aluminium halide may be condensed at a temperature of around 50° C.

In one embodiment, the reaction zone can be the second reaction zone of the first aspect.

In accordance with a fourth aspect, the present invention provides a reactor arranged in use for reacting aluminium with a metal halide or subhalide to produce a metal compound, the reactor comprising:

a reaction zone which is adapted in use to be heated to a temperature sufficient for the metal halide or subhalide to react with the aluminium to form the metal compound and aluminium halide; and a condensation zone arranged in use to operate at a temperature lower than the temperature in the reaction zone such that metal halide or subhalide escaping the reaction zone can be condensed in the condensation zone;

wherein the condensation zone is adapted for the return of only said condensed metal halide or subhalide into the reaction zone.

Such an apparatus permits operation of the reaction between aluminium and a metal halide or subhalide to occur with the continual removal of the aluminium halide reaction product accompanied by the continual return of condensed metal halide or subhalide into the reaction zone. Effectively this means that, after a period of operation, the reaction zone can develop a high operational concentration of metal halide and sub-halide (either recycled or sourced from new feed material) and a relatively low level of aluminium and aluminium-containing species, whilst being driven in a forward direction by the continual removal of the aluminium halide reaction product. This can lead to the production of a metal compound or alloy having a generally very low aluminium content.

In one embodiment, the condensation zone can comprise a condensation vessel that is arranged in fluid communication with the reaction zone.

In one embodiment, the condensation vessel can comprise a plurality of internal baffles for condensation and deposition of particulate metal halide or subhalides.

In one embodiment, the condensation vessel can comprise an internal scraping device for removing condensed metal halide or subhalides to allow their return to the reaction zone. Such a device can be manually operated or automated.

In one embodiment, the condensation zone can also be arranged to be in fluid communication with an aluminium halide collection vessel. In one form of this, the aluminium halide collection vessel may be arranged so that aluminium halide passes from the condensation zone and is separately condensed in the collection vessel so as not to be returned to the reaction zone via the condensation zone. In use, a unidirectional flow of gas can be arranged to pass consecutively though the reaction zone, the condensation zone and the metal halide collection vessel.

In one embodiment, the reaction zone operates at a temperature T1 and the condensation zone at a temperature T2 which is lower than the temperature T1. In one form, the metal halide collection vessel operates at a temperature T3 which is lower than either T1 or T2.

In accordance with a fifth aspect, the present invention provides a method of producing a metal compound, comprising the steps of:

heating feed reagents of metal subhalide(s) and aluminium in a reaction zone to a temperature sufficient to produce reaction products of aluminium halide and a metal compound; and moving the solid feed reagents and/or solid reaction products within the reactor in a unidirectional manner through the reaction zone.

In one embodiment, the step of moving the feed reagents and/or reaction products within the reactor can be generally continuous.

In accordance with a sixth aspect, the present invention provides a method of producing a metal compound, comprising the steps of:

heating feed reagents of metal subhalide(s) and aluminium in a reaction zone to a temperature sufficient to produce reaction products of aluminium halide and a metal compound; and moving a generally continuous flow of the solid feed reagents and/or solid reaction products to cross through the reaction zone.

In one embodiment, the flow of solid feed reagents and/or solid reaction products through the reaction zone can be unidirectional.

In one embodiment of either the fifth or the sixth aspects, the method step of moving the solid feed reagents and/or solid reaction products within the reactor can be from a low temperature region within the reactor to a higher temperature region thereof.

In one embodiment of either the fifth or the sixth aspects, the method step of moving the solid feed reagents and/or solid reaction products within the reactor can be automatically controlled by a control system which monitors one or more properties of the reaction products.

In one embodiment of either the fifth or the sixth aspects, the reaction zone can be the second reaction zone of the first aspect.

In accordance with a seventh aspect, the present invention provides a reactor having a reaction zone which is adapted in use to be heated to a temperature sufficient for reacting feed reagents of aluminium and a metal halide or subhalide to produce reaction products of aluminium halide and a metal compound, wherein a moving apparatus is arranged to move the solid feed reagents and/or solid reaction products within the reactor in a unidirectional manner through the reaction zone.

In accordance with an eighth aspect, the present invention provides a reactor having a reaction zone which is adapted in use to be heated to a temperature sufficient for reacting feed reagents of aluminium and a metal halide or subhalide to produce reaction products of aluminium halide and a metal compound, wherein a moving apparatus is arranged to move a flow of solid feed reagents and/or solid reaction products in a generally continuous flow within the reactor to cross through the reaction zone.

In one embodiment of the reactor of either the seventh or the eighth aspects, the moving apparatus can be arranged to convey the solid feed reagents from a feed reagent inlet to a reaction product outlet.

In one embodiment of the reactor of either the seventh or the eighth aspects, the moving apparatus can be arranged to mix the solid feed reagents during movement within the reactor and through the reaction zone.

In one embodiment of the reactor of either the seventh or the eighth aspects, the moving apparatus can comprise a rake with a plurality of scraping projections spaced along a shaft, the rake being operable in a reciprocal manner to scrape discrete amounts of solid feed reagents and/or solid reaction products along a floor of the reactor.

In one form of this, the rake may be arranged to be drawn in one direction to move discrete amounts of the solid feed reagents and/or solid reaction products a short distance along the reactor floor, and then to be oriented so as to be moved in a direction opposite to the one direction without contacting said solid feed reagents and/or solid reaction products.

In one embodiment of the reactor of either the seventh or the eighth aspects, the moving apparatus can comprise one of a conveyer belt, an auger (or screw feeder) and a rotary kiln.

In accordance with a ninth aspect, the present invention provides a method of producing a metal compound, comprising the steps of:

heating feed reagents of metal subhalide(s) and aluminium in a reaction zone to a temperature sufficient to produce reaction products of aluminium halide and a metal compound; and passing a flow of an inert gas comprising an amount of helium through the reaction zone sufficient to increase the thermal conductivity within the reaction zone.

In one embodiment of this method, the flow of inert gas can be passed through the reaction zone in a unidirectional manner. In one form of this, the flow of inert gas may be arranged to convey any gaseous reaction products along with the unidirectional flow.

In one form of this, if the solid feed reagents and/or solid reaction products are arranged to move within the reactor in a unidirectional manner through the reaction zone, the unidirectional flow of the inert gas can be in an opposite direction such that gaseous species do not diffuse in the direction of movement of the solid feed reagents and/or solid reaction products.

In one embodiment of the ninth aspect, the reaction zone can be the second reaction zone of the first aspect.

In accordance with a tenth aspect, the present invention provides a reactor having a reaction zone which is adapted in use to be heated to a temperature sufficient for reacting feed reagents of aluminium and a metal halide or subhalide to produce reaction products of aluminium halide and a metal compound, wherein the reactor is adapted for passing a unidirectional flow of a gas through the reaction zone.

In one embodiment, when the solid feed reagents and/or solid reaction products are arranged to move within the reactor in a unidirectional manner through the reaction zone, the unidirectional flow of the inert gas is arranged in an opposite direction.

In one embodiment, the reactor can further comprise a gas inlet located adjacent to a solid reaction product outlet.

In one embodiment, the reactor can further comprise a gas outlet located adjacent to a solid feed reagent inlet.

In accordance with an eleventh aspect, the present invention provides a stepwise method of producing titanium-aluminium compounds, comprising a first step of:

heating a mixture of $TiCl_4$ and aluminium to form products $TiCl_3$ and $AlCl_3$, at a temperature less than 220° C.;

and then a second step of:

mixing said products, with the addition of more aluminium if required, and heating the mixture to a reaction zone temperature above 900° C. to cause $AlCl_3$ to be evaporated from the reaction zone and to form titanium-aluminium compounds.

In one embodiment, the method of the eleventh aspect can be otherwise as defined in the first aspect.

In accordance with a twelfth aspect, the present invention provides a stepwise method of producing metal-aluminium compounds, comprising a first step of:

adding a reducing agent to reduce an amount of a metal halide to form metal subhalide(s) at a temperature below 220° C.;

and a second step of:

mixing said metal subhalide(s) with aluminium, and heating the mixture in a reaction zone to a temperature above 900° C. to form aluminium halides in a gas phase, and to produce an end product in the reaction zone comprising a metal compound containing a percentage of aluminium.

In one embodiment, the reducing agent can be selected from the group comprising zinc, magnesium, sodium, aluminium or other like metals. In one embodiment the metal halide can be a titanium subhalide such as titanium trichloride, and a product of the reaction can include titanium compounds.

In one embodiment, the method of the twelfth aspect can be otherwise as defined in the first aspect.

In accordance with a thirteenth aspect, the present invention provides a stepwise method of producing titanium-aluminium compounds, comprising a first step of:

mixing an amount of aluminium with an amount of aluminium chloride ($AlCl_3$) to form a mixture;

then adding an amount of titanium chloride ($TiCl_4$) to the mixture and heating the mixture to a temperature of less than 220° C. to form a product of $TiCl_3$, aluminium and $AlCl_3$;

and then a second step of:

adding more aluminium if required, and heating the mixture again to form titanium-aluminium compounds.

In one embodiment of the method, the first step can be conducted at a temperature below 200° C.

In one embodiment of the method, the first step can be conducted at a temperature below 160° C.

In one embodiment of the method, the first step can be conducted at a temperature below 136° C.

In one embodiment of the method, the first step can be conducted at a temperature below 110° C.

In one embodiment of the method, the first step can be conducted at a temperature below 60° C.

In one embodiment of the method, the mass ratio of aluminium to aluminium chloride ($AlCl_3$) used when forming the mixture can be between 2:1 and 1:2.

In one embodiment of the method, the first step can be conducted in the presence of an inert gas at atmospheric pressure.

In one embodiment, the respective heating steps of the thirteenth aspect can be the first reaction zone and the second reaction zone of the first aspect.

In accordance with a fourteenth aspect, the present invention provides an apparatus for the production of at least one of a titanium compound, another metal compound or a product, when the apparatus is used with a method as defined in any one of the preceding aspects.

In accordance with a fifteenth aspect, the present invention provides a titanium compound, a metal compound or a product produced by either the apparatus or the method as defined in any one of the preceding aspects.

In any of the embodiments described, the method can also comprise the further step of adding a reagent to a product of the method to produce a further product.

BRIEF DESCRIPTION OF THE DRAWINGS

Features and advantages of the present invention will become apparent from the following description of embodiments thereof, by way of example only, with reference to the accompanying drawings, in which:

FIG. 1 is a schematic diagram illustrating a stepwise method for production of titanium-aluminium compounds, in accordance with an embodiment of the present invention;

FIG. 2 is a schematic diagram of an apparatus for implementing a first step of a stepwise method for production of titanium-aluminium compounds, in accordance with an embodiment of the present invention;

FIG. 3 illustrates the Ti concentration (in weight %) in Ti—Al powders produced using a starting fine Al powder (<15 μm) as a function of the $[Al]/[TiCl_3]$ ratio produced, in accordance with an embodiment of the present invention. Also shown are the yields and phases identified in the products;

FIG. 4 is a schematic diagram of a further embodiment of an apparatus for implementing both a first step and a second step of a stepwise method for production of titanium-aluminium compounds, in accordance with an embodiment of the present invention;

FIG. 5 illustrates the calculated composition of $TiCl_3$ under argon at 1 atm in a temperature range up to 3000 K, produced in accordance with an embodiment of the present invention;

FIG. 6 illustrates the calculated composition of $TiCl_2$ under argon at 1 atm in a temperature range up to 3000 K, produced in accordance with an embodiment of the present invention;

FIG. 7 illustrates the calculated composition of $TiCl_3$—Al under argon at 1 atm in a temperature range up to 3000 K where $[Al]/[TiCl_3]=0.82$, produced in accordance with an embodiment of the present invention;

FIG. 8 illustrates the calculated composition of $TiCl_3$—Al under argon at 1 atm in a temperature range up to 3000 K where $[Al]/[TiCl_3]=0.5$, produced in accordance with an embodiment of the present invention;

FIG. 9*a* illustrates an XRD spectrum obtained at the start of the run (8.5 wt % Al), starting from 127 ml of $TiCl_4$ and 37.2 g of Al flakes, produced in accordance with an embodiment of the present invention;

FIG. 9*b* illustrates an XRD spectrum obtained towards mid-time of the run (7 wt % Al), starting from 127 ml of $TiCl_4$ and 37.2 g of Al flakes, produced in accordance with an embodiment of the present invention; and FIG. 9*c* illustrates an XRD spectrum obtained at the end of the run (1.5 wt % Al), starting from 127 ml of $TiCl_4$ and 37.2 g of Al flakes, produced in accordance with an embodiment of the present invention.

DESCRIPTION OF PREFERRED EMBODIMENTS

The following description is of embodiments of processes for producing metal compounds, including fine powder and ingots with specific compositions. The processes are useful for production of various forms of metals such as titanium, vanadium and zirconium together with alloys and intermetallic compounds of these metals with a controllable amount of aluminium and with a controllable composition. For example, titanium compounds such as Ti—Al, $Ti_3Al$, $TiAl_3$, Ti—Al—Cr and Ti—Al—V can be made with accuracy by varying the aluminium content. The relative amounts of titanium and aluminium are determined by the required composition of end product.

The stepwise method to produce these compounds provides improvements over prior art processes aimed at single step reduction of titanium tetrachloride with aluminium, and allows for a direct and accurately controllable production of powders of both conventional Ti—Al alloys such as Ti-6Al-4V and also titanium-aluminium intermetallic based alloys, starting from low cost materials. Furthermore, the method also allows for the incorporation of a large number of alloying additives to the end product, hence providing a direct method for producing low-cost powder of titanium-aluminium based alloys.

An embodiment of the stepwise process for production of titanium-aluminium alloys is shown in the schematic block flow diagram shown in FIG. 1. This embodiment is based on reduction of titanium tetrachloride ($TiCl_4$) with aluminium according to the following simplified reaction schemes:

$$TiCl_4+\tfrac{1}{3}Al \rightarrow TiCl_3+AlCl_3 \qquad \text{Step 1}$$

$$TiCl_3+(x+1)Al \rightarrow Ti—Al_x+AlCl_3 \qquad \text{Step 2}$$

Step 1 of the process is based on controllable exothermic reactions between solid aluminium ($Al_{(s)}$) and titanium chloride ($TiCl_{4(1)}$ and $TiCl_{4(g)}$) for example at temperatures below 200° C., or even below 160° C. Step 1 can also be carried out at temperatures below 136° C., or even below 110° C. for reactions between $Al_{(s)}$ and $TiCl_{4(1)}$.

The reaction for Step 2 is based on both solid-solid and solid-gas reactions between titanium subchlorides and aluminium and is carried out at a temperature above 900° C., typically 1000° C.

Referring to FIG. 1, aluminium materials (1) are introduced together with an appropriate quantity of $TiCl_4$ (3) into a cell to carry out Step 1 of the process at temperatures below 200° C. in a first reaction zone. Details of an appropriate cell for the Step 1 reaction will be described shortly. At the end of this reduction step, the remaining un-reacted $TiCl_4$ (7) is separately collected from the resulting solid intermediate products of $TiCl_3$—Al—$AlCl_3$, and this un-reacted $TiCl_4$ can be recycled as illustrated in FIG. 1. In the embodiment shown in FIG. 1, the aluminium is additionally thoroughly mixed with anhydrous aluminium chloride $AlCl_3$ (2) just prior to being added to the $TiCl_4$. The advantages of using some $AlCl_3$ as a catalyst will be discussed in more detail shortly.

Step 2 reactions are then initiated. The solid intermediate products from Step 1 are then mixed properly so as to obtain a powder in which remaining un-reacted Al is generally distributed uniformly. The mixture is then heated to a temperature of more than 900° C. (typically to 1000° C. or more) in a second reaction zone to drive the reaction to completion. Details of an appropriate reactor for the Step 2 reaction will be described shortly. The resulting $AlCl_3$ by-product (8) is produced in a gas phase and is continuously removed from the second reaction zone, which has the effect of driving the reaction of Step 2 in a forward direction. The $AlCl_3$ is collected in a separate vessel, which will shortly be described.

In Step 1, the feed reagent mixture of $TiCl_4$ and Al, along with $AlCl_3$ as catalyst, is heated in the first reaction zone to a temperature below 200° C. with an appropriate amount of Al so as to obtain an intermediate solid powder of $TiCl_3$—Al—$AlCl_3$. In some embodiments, the heating temperature can even be below 136° C. so that the solid-liquid reactions between $TiCl_4$ and Al are predominant (i.e. below the boiling point of $TiCl_4$ of 136° C.). The feed reagent mixture of $TiCl_4$—Al—$AlCl_3$ can be stirred in the first reaction zone whilst being heated so as the resulting products of $TiCl_3$—Al—$AlCl_3$ are powdery and uniform. By adding an amount of aluminium in excess of the stoichiometric amount required, all of the titanium chloride can be reduced to form the resulting products of $TiCl_3$—Al—$AlCl_3$ which means that it may not be necessary to add any further aluminium for the subsequent reaction of Step 2.

Apparatus that can be used to carry out Step 1 include reactor vessels that are operable in a batch or in a continuous mode at temperature below 200° C. Operating pressure in such a reactor can be a few atmospheres, but is typically around 1 atmosphere. Aluminium chloride ($AlCl_3$) has a sublimation point below 200° C., and so it is desirable to maintain this reaction product of Step 1 in solution. Since the sublimation point of aluminium chloride ($AlCl_3$) is around 160° C., in some embodiments the inventors have shown that it can be advantageous to perform Step 1 below 160° C. Since aluminium chloride ($AlCl_3$) acts as a catalyst for the reaction between titanium chloride and aluminium, in such embodiments the inventors have found that, by maintaining the reaction of Step 1 below the sublimation point of aluminium chloride ($AlCl_3$), a solid phase of $AlCl_3$ remains in the reaction zone to allow improved particulate surface reactions to occur, rather than being present in a gaseous form. Other advantages of particulate/powder mixing in Step 1 are discussed shortly in this specification.

Also, it has now been observed by the inventors that, if the temperature in the first reaction zone rises to above 220° C., the reaction between $TiCl_4$ and Al proceeds in an uncontrollable manner so that the temperature rises uncontrollably, resulting in formation of lumps of Al powder and/or formation of the compound $TiAl_3$ at this early stage. The early formation in Step 1 of different Ti—Al intermetallic compound forms (such as $TiAl_{3(s)}$, $TiAl_{(s)}$ and $Ti_3Al_{(s)}$), and the subsequent reaction of each of these forms in Step 2 to a different extent with $TiCl_{3(g)}$, can lead to a wide variation in the nature of the titanium-aluminium product which results from the stepwise process. If this is allowed to occur, the reaction rate can also then become very slow, and the resulting products may be unsuitable for further use and production of other more desirable Ti—Al alloys with good qualities. For these reasons, controlling the Step 1 reaction temperature of less than 220° C. and especially below 200° C. is important. This is discussed again shortly in this specification in relation to the experimental Example 3.

It is advantageous to have titanium-aluminium compounds produced in powder form. The powder form is much more versatile in manufacture of titanium aluminium alloy products, eg shaped fan blades that may be used in the aerospace industry. The present inventors have observed the reaction in Step 1 is influenced by the particle size of the Al powder and that the reaction is more efficient for smaller particle sizes. For the stepwise process described herein, the product is typically in the form of a fine powder. The powder may be discharged from the vessel, at the completion of chemical reactions in the first and second reaction zones, for further processing. Alternatively, the powder may be further processed in-situ for production of other materials. Alternatively the powder may be heated in-situ to make coarse grain powder. In a further embodiment, the powder may be compacted and/or heated in-situ and then melted to produce ingot.

The aluminium to be mixed with the titanium chloride in Step 1, (or if necessary, any additional aluminium required to be added to titanium subchloride in Step 2) is, in one embodiment, in fine powder form, usually having an approximate grain top size of less than 50 micrometers in diameter. Fine aluminium powder is usually available with a top size of less than 50 micrometers in diameter, but such a raw material is quite expensive to produce and therefore, if used, can increase the cost of the process. Therefore it is possible for coarser aluminium powder to be used in the present method, where the powder has an approximate grain top size of greater than 50 micrometers in diameter. In such examples, aluminium chloride is added to the coarse aluminium powder and the mixture then mechanically milled to reduce the dimensions of the aluminium powder in at least one dimension. This can result in the production of "flakes" of aluminium which have a size in at least one dimension which is less than 50 micrometers and which is sufficient to facilitate a satisfactory reaction between the titanium subchlorides and the aluminium. Flakes provide a higher reaction surface area and the small thickness of the flakes results in a more uniform composition of product.

In a further alternative embodiment, the aluminium raw material may be obtained in the form of flakes (that is, already pre-milled) and mixed with the titanium chloride before reaction commences. In a still further embodiment, the aluminium raw material can be milled together with the titanium chloride if the aluminium is initially available in a coarser particle size (such as in a lump form). In this way an intimate mixing between the feed materials for Step 1 can be achieved prior to heating in the first reaction zone.

In a further embodiment of this, if coarser (and cheaper) aluminium raw material is to be milled together with titanium chloride ($TiCl_4$) raw material, the milling can be arranged to be coincident with the reaction of these two substances in a first reaction zone to form $TiCl_3$ and $AlCl_3$. Such reactive milling can be used if the milling process generates sufficient heat (or if the feed substances are pre-heated to some extent) so that the Step 1 reaction at least partly takes place in the mill. Of course such a reactive milling also provides a convenient point for the addition of sources of further elements as alloying additives, and to facilitate intimate mixing of such elements with the $TiCl_3$ and $AlCl_3$ products in the first reaction zone to lead to the formation of many types if new alloys, as will be further discussed shortly.

In a still further embodiment, the milling of a coarser aluminium feed material or aluminium flakes can be performed in the presence of some initial amount of aluminium chloride ($AlCl_3$), for reasons which will now be explained.

The inventors have observed that the addition of $AlCl_3$ to the starting aluminium powder can results in an improvement in the efficiency of the reaction of Step 1. $AlCl_3$ can have the effect of catalysing the reaction between $TiCl_4$ and aluminium and is both highly adsorbent to aluminium powder and has a great affinity to $TiCl_4$. By mixing Al powder with $AlCl_3$ in a mass ratio between 2:1 and 1:2, the inventors have observed that this seems to enable early activation of reactions between Al and $TiCl_4$. It has been observed that, in the presence of $AlCl_3$, the activation temperature of the reaction in Step 1 can be decreased from around 200° C. for direct reactions between $TiCl_4$ and Al to an activation temperature of less than 136° C. and even as low as 60° C., representing a significant reduction in operational cost and complexity.

It has also been observed by the inventors that instead of needing to operate the reactor for Step 1 at a pressure of a few atmospheres of an inert gas in order to pressurise (and therefore to speed up) the reaction process, when using $AlCl_3$ as a catalyst it has been found possible to simply operate the reactor for Step 1 at a single atmosphere of pressure. This also represents a significant simplification of the reactor design, which may further reduce operational costs as well as scale-up complexities.

As has been discussed previously, the reaction in Step 1 is influenced by the particle size of the Al powder and the inventors have observed that the reaction is more efficient for smaller particle sizes. However, as well as being expensive, commercial grade fine Al powder may contain high level of oxygen which can become retained in the end products of Ti—Al alloys and leads to deterioration of the quality of these alloys. Therefore there is an incentive to move away from the use of such commercial grade aluminium powders and to use coarser aluminium as a starting material, and milling it as has already been described. As a further advantage of the early addition of $AlCl_3$, the present inventors have observed that when milling coarse Al powder in the presence of an amount of $AlCl_3$, the $AlCl_3$ acts as a surfactant to prevent the aluminium particles from lumping together during milling.

An example of a reactor for carrying out Step 1 is presented in FIG. 2. In this example, a mixture of aluminium and $TiCl_4$ (and optionally aluminium chloride) is introduced into a cylindrical stirred batch cell (20) (stirrer not shown), the cell equipped with fluid-containing coils (22) positioned around the external walls through which hot oil or steam can be moved to provide heat energy into the cell (when an endothermic reaction is to take place within a reaction zone in the cell), or alternatively through which cooling fluids or gases can be moved to remove heat energy from the cell (when an exothermic reaction is to take place within the cell). In further embodiments the temperature of the reagents and reactions within the cell can be controlled in many other physical arrangements, such as by a full jacket located around the cell walls rather than just the circumferential coils containing fluid shown in FIG. 2.

The cell shown in FIG. 2 is also fitted with an upwardly extending water-cooled condenser tube (24) fitted with an uppermost pressure escape valve (26). The condenser tube serves to condense vaporous $TiCl_4$ and return it to the reaction zone in a liquid form and also to maintain moderate pressures within the cell when it is heated at temperatures above the boiling point of $TiCl_4$ at 136° C. Similarly, if any titanium subchlorides escape the cell, these can also be condensed and returned to the reaction. Typically the cell has a normal operating pressure above the reactants and products of around 1 atmosphere pressure of an inert gas such as argon or helium. For this mixture, heating the materials to 110° C. causes a thermal runaway effect, increasing the temperature of the vessel to around 170° C. which usually reduces more than 90% of the $TiCl_4$.

In the particular example of the method depicted in the block diagram in FIG. 1, in Step 1 aluminium and $TiCl_4$ are introduced into a cylindrical stirred batch cell together with an equivalent amount of $AlCl_3$. As has been mentioned, the beneficial effects of $AlCl_3$ can be to catalyse the process to significantly reduce: (i) the reaction time, (ii) the activation temperature, (iii) the overpressure requirement, and (iv) the formation of lumps of aluminium particles in Step 1 in the reactor.

For an Al powder with a particle size less than 15 microns, the reaction time can be less than 15 minutes. The reaction time decreases with an increasing amount of Al powder in the cell, making it more advantageous to introduce the entire Al required for the reactions of Steps 1 and 2 into Step 1.

In alternative embodiment of the Step 1 reactor cell, other possible configurations may include automated array of cells operated sequentially, simulating a continuous production unit. There may be a different heating arrangement for heating the feed materials to trigger the reactions to form $TiCl_3$ and $AlCl_3$. In some embodiments, openings can be provided in the cell for the introduction or pressurisation of further gases. Openings may also be provided to evacuate the vessel to a low pressure. Other arrangements based on continuously feeding the starting materials of aluminium, titanium chloride and optionally aluminium chloride to produce the Step 1 reaction products of $TiCl_3$—Al—$AlCl_3$ can include configurations such as screw-type reactors and fluidised bed reactors. In still further embodiments there may also be a number of arrangements other than those mentioned here.

Some experimental results from the reaction of Step 1 will now be outlined.

Example 1

15 g of Al powder<15 micrometers
15 g of $AlCl_3$
125 ml of $TiCl_4$

At 110° C., there is a thermal runaway effect. The temperature increases rapidly to 176° C. The cell is then cooled down and the remaining $TiCl_4$ is removed. 239 g of materials remain in the cell, equivalent to the reduction of around 122 ml of $TiCl_4$, corresponding to an efficiency of ~97%. The resulting intermediate products ($TiCl_3$+Al+$AlCl_3$) have a violet colour and are usually in the form of an agglomerated powder, requiring crushing before proceeding into the reaction in Step 2.

Example 2

15 g of Al flakes, 1-2 micrometers thick,
15 g of $AlCl_3$
125 ml of $TiCl_4$

The cell shown in FIG. 2 is open to 1 atmosphere under Argon, due to the beneficial influence of the $AlCl_3$ catalyst. At 110° C., there is a thermal runaway effect. The temperature increases rapidly to 172° C. The cell is cooled down and remaining $TiCl_4$ is removed. 230 g of materials remain in the cell, equivalent to the reduction of around 116 ml of $TiCl_4$, corresponding to an efficiency of ~93%. Total reaction time was 15 minutes.

Example 3

For Al powders with a particle size less than 44 micrometers, the addition of $AlCl_3$ to the starting materials enabled the reaction to proceed at 1 atm, producing intermediate products adequate for production of titanium aluminides. For example, starting from a mixture of 15 g of Al powder (<15 microns) and 15 g of $AlCl_3$ together with 125 ml of $TiCl_4$ lead to formation of around 150 g of intermediate products ($TiCl_3$+

$Al+AlCl_3$) after heating at 136° C. for 1 hour. For operation at 1 atm, the reaction between $TiCl_4$ and Al without $AlCl_3$ is usually slower than under high pressure in a closed vessel, as the reaction would then be mostly limited to liquid-solid reactions.

As has already been noted earlier, carrying out the reaction of Step 1 at temperatures higher than 220° C. can cause a number of difficulties, such as the reaction proceeding in an uncontrollable manner so that the temperature rises uncontrollably, resulting in formation of unwanted products and a slowing of the reaction rate. In some experiments to investigate this phenomenon, the inventors observed a partial reduction of $TiCl_4$ to $TiCl_2$ when there were rapid increases in the measured temperature in the reactor to more than 250° C. The resulting products were in the form solid black materials consistent with the physical appearance of $TiCl_2$, and this effect was usually associated with a very low reduction of the $TiCl_4$. The amount of $TiCl_4$ that was actually reduced could be readily measured at the end of the reaction interval by removal of the remaining un-reacted $TiCl_4$, which is usually a significant quantity, leaving behind only a small quantity of actual reaction product materials.

Furthermore, the inventors also observed that the reaction product materials seemed to contain sintered Al powder, suggesting that heat from the reaction had caused the Al powder to sinter, resulting in considerable decreases in the contact surface area available for reaction with the $TiCl_4$, and thus reducing the reaction rate.

Some of the products obtained at the end of reactions which occurred at higher temperatures also contained significant quantities of $TiAl_3$, making them unsuitable for producing titanium aluminium products with a uniform composition. In particular, for production of Ti—Al alloys with a low Al contents, the presence of $TiAl_3$ in the materials particularly in lump forms makes it very difficult to obtain uniform materials, usually requiring extended heating and much further processing to be made into a useful form. It was observed that the heat generated by the reaction between $TiCl_4$ and Al, if uncontrolled, can cause reaction temperatures to increase to somewhere above 500° C., which leads to the formation of $TiAl_3$.

Example 4 was illustrative of this:

Example 4

15 g Al powder<15 micrometers 125 ml $TiCl_4$

These reagents were mixed in a closed cell, and no thermal runaway effect was observed until the reaction temperature was allowed to reach 220° C. where there was a rapid increase in the temperature to 255° C. as measured on the external wall of the cell. This was then followed by rapid decrease of the cell temperature. The cell was then kept at 250° C. for 12 hours, and then cooled down and the remaining $TiCl_4$ then removed. 48 g of solid materials remained in the cell, having a deep black appearance and of a very hard nature. This result was calculated to correspond to reduction of only 33 g of $TiCl_4$.

If it was assumed that there was a full reaction between the titanium subchlorides in the resulting intermediate products with the remaining Al as part of a subsequent higher temperature Step 2, the total quantity of product that would be obtained at the end of the second high temperature step would be around 8.3 g of Ti and 9 g of Al. Such a composition is unsuitable for the production of alloys with a low Al content, and can only lead to products rich in $TiAl_3$ after processing at 1000° C.

The $TiCl_3$ and $AlCl_3$ reaction products of any of the examples of Step 1 described above are fed into a reactor to carry out the second reaction step at temperatures more than 900° C., typically around 1000° C. or more. The amount of Al in the intermediate products may need to be adjusted according to both the required end product and the efficiency of the reaction. This amount is determined according the theoretical stoichiometric requirements of reactions in Step 1 and Step 2, and taking into account the efficiency of the reaction in both steps. If necessary, any additional aluminium is added to titanium subchloride in Step 2.

The $TiCl_3$ is mixed with aluminium and then heated to a temperature above 900° C. so that $AlCl_3$ is formed in the gas phase and the $AlCl_3$ is condensed away from the reaction zone of the reactor at a temperature below the reaction zone temperature but above the condensation temperature of $AlCl_3$. The reaction leaves a powder of Ti in the reaction zone containing a percentage of aluminium, as required for the end product. In one embodiment, the driving of the aluminium chloride away from the reaction zone moves the equilibrium of reaction in the forward direction i.e. to formation of aluminium chloride and Ti—Al metal compounds (and other products depending upon reaction conditions and components). In general the reaction vessel used is arranged to allow for aluminium chloride to be continuously removed and condensed in a region away from the reaction zone of the titanium chloride and aluminium mixture.

Step 2 is illustrated using the simplified reaction $TiCl_3+(1+x)Al \rightarrow Ti—Al_x+AlCl_3$, and is mostly based on solid-solid reactions between $TiCl_3$ and Al compounds. However, at temperature above 600° C., where titanium subchlorides can decompose and sublime resulting in the presence of gaseous species of $TiCl_{4(g)}$, $TiCl_{3(g)}$ and $TiCl_{2(g)}$, gas-solid reactions may occur between these species and Al-based compounds in the solid materials. Step 2 is therefore usually better carried out at a temperature of 1000° C. or more, to produce more consistent products. Apart from anything else, Step 2 is too slow when carried out at 600° C., and higher temperatures are better.

For production of gamma Ti—Al, the relative amount (mass) of Al to $TiCl_3$ should be equal to 0.35 assuming an efficiency of 100%. It follows that for $M_{tic13}$, an amount of Al powder equal to 0.35 $M_{tic13}$ is needed to produce stoichiometric Ti—Al. For the class of aluminides including $Ti_3Al$, Ti—Al and $TiAl_3$, losses of titanium chlorides due to evaporation and/or decomposition are minimal. The yield of the process, defined here as the ratio of the amount of Ti in the end products to the amount of Ti in the $TiCl_3$ intermediate materials, is higher than 90% as can be seen in FIG. 3. FIG. 3 shows the composition of the end products as a function of the Al content in the starting materials using Al powder with a particle size less than 15 micrometers. The corresponding yields are also marked there. For these results, the total weight of starting materials was less than 5 g and the experiments were carried out in a batch mode using a quartz tube.

In the above-described processes, it is possible to include sources of other materials to obtain products of desired composition. For example, these source materials may include vanadium chloride ($VCl_4$) and vanadium subchlorides, such as vanadium trichloride ($VCl_3$) and/or vanadium dichloride ($VCl_2$) and the products may include titanium-aluminium-vanadium compounds, for instance Ti-6Al-4V (i.e. a titanium with 6% aluminium and 4% vanadium, which because of its composition has improved metal properties such as better creep resistance and fatigue strength, and the ability to withstand higher operating temperatures).

For production of Ti-6Al wt %, the relative amount of Al to $TiCl_3$ prior to Step 2 must be below 1, as illustrated in the results in FIG. 3. For example, for Ti-6Al, the ratio [Al]/[$TiCl_3$] is around 0.5, suggesting 0.0875 g of Al powder are needed for every 1 g of $TiCl_3$. It follows that for this particular example of an alloy containing 6 wt % Al, the ratio [Al]/[$TiCl_3$] must be equal to 0.5 as the materials progress towards the high temperature region at around 1000° C. Intermediate products containing more than 0.0875 $M_{tic13}$ cannot be used to produce the required low-Al alloy.

For production of Ti-6Al-4V, $VCl_4$, $VCl_3$ or $VCl_2$ can be added to materials before Step 1. Alternatively $VCl_3$ or $VCl_2$ may be added to the intermediate products prior to heating in Step 2. Sources of other materials to obtain desirable intermetallic products may include chromium halides (e.g. $CrCl_2$) and the products may include titanium-aluminium-chromium compounds. Niobium halide (e.g. $NbCl_5$) may also be added as a starter material to produce titanium-aluminium-niobium-chromium compounds, for instance Ti-48Al-2Nb-2Cr.

Alloying additives can be included in the reaction zones in either (or both) of Step 1 or Step 2. For example, these solid chemicals may be mixed with the $TiCl_3$—Al—$AlCl_3$ obtained at the end of Step 1, prior to heating at 1000° C. A large number of other compounds are suitable for inclusion here. For example, the inventors have been able to introduce carbon into gamma-TiAl down to a level of 0.2 at % in two different ways: (i) through liquid $CCl_4$ in Step 1 and (ii) through $CI_6$ in Step 2. Carbon is one of the most difficult elements to alloy with titanium due to its low solubility of less than 0.5 at %.

In addition to those already mentioned, sources (such as halides, sub-halides, pure element or another compound including the element) of other elements suitable as alloying additives can contain zirconium, silicon, boron, molybdenum and tantalum, and the products of the stepwise method are titanium-aluminium compounds which include one or more of these elements, some of them possibly themselves being "new" alloys, not previously known. The products of the stepwise method can also be in the form of titanium-(selected element)-alloys and intermediate compounds.

A schematic diagram of a reactor to carry out the Step 2 high-temperature step of the stepwise process is shown in FIG. 4. This reactor is in the form of a stainless steel pipe reactor (30) that is partially positioned inside a high temperature furnace (32) capable of heating the central section of the pipe to 1000° C. Powdered metal halide (such as $TiCl_3$) and aluminium products from the Step 1 reaction are fed into one end (34) of the pipe reactor (30) via a rotary screw feeder (36) which is positioned underneath a valve (38) that is located at the base of the particular version of the Step 1 reaction cell (40) that is shown. The screw feeder (36) can function to mix the powdered metal halide and the aluminium together so that the unreacted aluminium is distributed substantially uniformly in the resulting mixture, especially if additional aluminium is being added at that point. This is also a good place to mix in any sources of other elements to be included in the metal-aluminate product from Step 2 (such as halides, sub-halides, pure elements or other compounds including the element etc.). The screw feeder (36) delivers product from the Step 1 reaction as feed materials for Step 2 through a conduit (42) and a reagent inlet into the steel pipe reactor. The reagent inlet is in the form of a hole (44) located in an uppermost surface of the steel pipe. The hole is located in a relatively cooler end region (34) of the pipe reactor (30) which is not surrounded by the high temperature furnace, and where the temperature is only about 300° C.

Once inside the pipe reactor (30), the metal halide and aluminium feed reagents are then moved within the reactor in a unidirectional manner from the cooler end region (34) of the pipe into the heated reaction zone (46) (known herein as the second reaction zone) which is located in that region of the pipe which is positioned inside the high temperature furnace (32). The unidirectional movement of solids occurs from the left to the right of the tube reactor (30) as shown in FIG. 4. At this point the feed reagents become heated and are gradually converted into the Step 2 reaction products of a titanium-aluminium compound and $AlCl_3$. The movement of the feed reagents and/or the reaction products in a unidirectional manner inside the reactor (30), so as to cross through the furnace region (46) and to reach the other (opposite) cooler end of the pipe (48), is accomplished using a moving apparatus. One form of this moving apparatus is shown in FIG. 4 in the form of a rake (50) having a series of spaced-apart projections in the form of scrapers (52). The scrapers (52) of the rake (50) are semi-circular discs of molybdenum (or stainless steel) each fixed to a rod (54) which extends along the axis of the tube reactor (30). In the particular embodiment used, the rake (50) has a series of 23 scrapers (52) each separated from an adjacent scraper by a 40 mm distance. Materials introduced into the pipe reactor (30) are moved by operating the rake (50) in a reciprocal manner to scrape amounts of the feed reagents and/or the reaction products along the floor (56) of the tube reactor (30). In use, the rake (50) is drawn axially outwardly in one direction (to the right in FIG. 4) and the 23 scrapers (52) are oriented downwardly so that each scraper (52) can move a discrete amount of the solid feed reagents and/or solid reaction products a short distance along the reactor floor (56). As the scrapers each reach their predetermined maximum travelling distance along the floor of the tube reactor of 40 mm, the rod (54) is rotated, thus rotating the scrapers (52) so that they are each then oriented vertically upwardly. In this position, the scrapers (52) are able to then be pushed axially inwardly into the reactor (30) (toward the left direction in FIG. 4) by a return travelling distance of 40 mm without contacting the solid feed reagents and/or solid reaction products that are located on the reactor floor (56). The rod (54) is then rotated so that the scrapers (52) are once again oriented vertically downwardly and back into their starting position.

The process of moving the rake (50) and its scrapers (52) can then be repeated in a reciprocal manner, allowing for discrete transfer of materials from the reactor inlet hole (44) towards its solid exit. When the rake (50) is being operated in a continuous reciprocal motion, the flow of materials through the reactor (30) can be considered to be generally continuous. The frequency of these movements determines the residence time for the materials at high temperature inside the reactor (30), depending on the required end product. The timing, speed and frequency of these movements are automatically controlled by a control system. This system uses a computer which can be connected to a monitoring system which monitors some physical property of either the reactor or the reaction products to maximise the performance of the Step 2 reaction.

The movement of solids within the reactor configuration shown in FIG. 4 can overcome problems associated with the behaviour of $TiCl_x$ and Al at high temperatures. The inventors had noted that when the feed reagent materials are heated to a temperature around 700° C. they can tend to sinter into larger lumps, preventing movement of materials across the second reaction zone (46) towards the solid reaction product exit. The scraper (52) arrangement shown in the embodiment in FIG. 4 overcomes this problem as the powder is physically moved along the length of the pipe reactor (30), the scraping and moving also promoting the mixing of the solid feed reagents and the break-up of any sintered lumps, thus also giving a more consistent reaction product.

The scraper system described here is only aimed at illustrating the concept of continuous or generally continuous operation and different designs may also be used. In further embodiments, the moving apparatus can be present in other forms, for example as a conveyer belt or an auger (screw feeder) or a rotary kiln, so long as in each of these forms the feed reagents and/or solid reaction products can be moved within the reactor and through a second reaction zone.

Once the rake (50) has moved the feed reagents and/or solid reaction products over the reactor floor (56) and through the second reaction zone (46), the solid reaction products of a titanium-aluminium alloy powder can be discharged in a generally continuous manner out of the end region of the reactor tube and down a sloping chute or funnel (58) into a product container (60).

Inert gas flows at a low rate through the pipe reactor (30) in a direction that is opposite to the movement of the solid feed reagents and/or solid reaction products through the pipe reactor (30). The gas flow rate used through the reactor is sufficient to prevent diffusion of gaseous chlorine-based species (such as $AlCl_3$) from flowing in the direction of the solid flow. Gases flow into the pipe via the end inlet hole (62) and flow through the second reaction zone (46) within the pipe reactor (30) and exit through a port (64) located near the solid feed reagent inlet hole (44), as shown in FIG. 4. These gases, including $AlCl_{3(g)}$ and unreacted $TiCl_{3(g)}$ together with the inert gas stream, proceed through the gas exit port (64) and into a condensation zone within a condensation vessel, in FIG. 4 being shown in the form of a condenser tube (66) which extends vertically upward from the pipe reactor (30). The condenser tube (66) is fitted with a cooling system to control the tube interior temperature above 250° C. so that $AlCl_{3(g)}$ does not condense but is maintained as a gas (condensation occurs below about 200° C.). $TiCl_{3(g)}$ however will condense below 430° C., so the gas stream exiting from the condenser tube (66) will comprise $AlCl_{3(g)}$ and inert gas, and the metal halide or subhalides which may have been present in the gas stream (such as $TiCl_{3(g)}$ and $TiCl_{4(g)}$, if any) will be condensed within the condenser tube (66). In one form the condenser tube (66) is fitted with a cooling system to control the tube interior temperature to anywhere between about above 250° C. and about below 430° C. The condenser tube can also be fitted with a series of internal baffles which to collect fine particles of titanium subchlorides that may be carried out of the tube reactor (30) by the gas stream.

The resulting powder of condensed $TiCl_{3(s)}$ is then returned directly into the pipe reactor for remixing with the feed materials of aluminium and $TiCl_{3(s)}$. This is accomplished by using an internal scraping device in the form of a plunger (68) which can be reciprocally axially moved within the interior of the condenser tube (66) to dislodge condensed or deposited $TiCl_{3(g)}$ located on the interior walls or wall baffles thereof. The dislodged material then falls back down into the tube reactor (30) to be recycled. The dislodged material is mixed with fresh feed materials being fed into the tube reactor (30) and is then passed into the reactor zone (46) by the movement of the rake (50).

The gases escaping the condenser tube, including $AlCl_{3(g)}$ together with the inert gas stream, then proceed through to a separate aluminium halide collection vessel (70) which is arranged to be operated at a temperature below the condensation temperature of $AlCl_{3(g)}$. This collection vessel (70) is typically operated at room temperature, or less than 50° C. Here, $AlCl_{3(s)}$ is extracted in a powder form while the remaining gas stream is processed through a sodium hydroxide scrubber prior to recycling of the inert gas (such as helium or argon), or releasing into the atmosphere. The physical arrangement of the collection vessel (70) means that there is no possibility of condensed $AlCl_{3(g)}$ or $AlCl_{3(s)}$ re-entering the $TiCl_{3(s)}$ condenser tube (66) or the tube reactor (30). In this way, $AlCl_3$ can be continually withdrawn from the reactor tube but virtually no losses of titanium will occur out of the system.

As already mentioned, $TiCl_3$—Al is fed in at one end of the reactor tube (30) and the rake scrapers (52) move these feed materials towards the feed product powder exit (58) located at the opposite end (48) of the reactor tube (30), passing through central region of the reactor (the second reaction zone (46)) at a temperature of 1000° C. or more. As the reaction between $TiCl_3$ and Al proceeds, $AlCl_3$ is produced in the gas phase and is carried by the inert gas stream towards the gas exit where it is collected as described before. Very small amounts of titanium tetrachlorides ($TiCl_4$) that may form in the reactor due to the decomposition of titanium subchlorides can react with Al powder in the furnace as these materials travel towards the product exit. In FIGS. 5 and 6, the inventors have presented theoretical calculations to show that for the method disclosed herein, the losses of titanium chlorides are small. Gasified titanium subchlorides that emanate from the high temperature region in the reaction zone (46) of the tube reactor (30) are recondensed as they travel towards the low temperature section(s) of the reactor (34), where they are remixed with the stream of feed $TiCl_3$ and Al materials moving in the opposite direction.

In further embodiments, the condensation zone can be other than a separate condensation vessel. Instead of being in the form of an external condenser tube, the zone can comprise a temperature controlled portion of the internal roof of the reactor tube, for example in the "cooler" region at the end (34) of the tube nearest to the feed material inlet area (42, 44). Such a configuration would also allow the direct return of condensed $TiCl_3$ into the tube reactor for mixing with the Step 2 feed materials.

The residence time of material in the second reaction zone in the reactor tube is determined by the composition and properties of the required end products. For titanium aluminides with a relatively high Al content, only a short residence time at 1000° C. is required. By contrast, for powdered products of low Al content, such as Ti-6Al, there are an excess of titanium subchlorides that needs to be removed from the powder prior to proceeding towards the exit. As a result more heat is required and the material needs to remain longer at 1000° C. to minimise the chlorine content in the processed materials.

Typically the gaseous atmosphere in either of the reaction in Step 1 and Step 2 is an inert gas, such as argon, helium, neon, xenon. Reactive gases such as methane or oxygen are undesirable as they can chemically react with the mixture resulting in other products. It is noted that the reactions can also be conducted in the absence of a gaseous atmosphere (eg under vacuum). In Step 2, because the heat flow into the reactor tube occurs mainly by conduction from the reactor tube walls toward the inner region where the feed materials and reaction products are located, the inventors have also found that by operating the tube reactor using an inert gas flow comprising an amount of helium (instead of, say, argon), that the residence time in the reactor can be decreased by a factor of more than 5, to a residence time of less than a few minutes. This decrease can be mainly ascribed to the high thermal conductivity of helium relative to argon, leading to improved thermal conduction. The inventors have discovered that the quantity of helium in the gaseous atmosphere in Step 2 needs only to be of a sufficient amount to increase the thermal conductivity within the reaction zone, and so the entire composition of the gas need not be helium, but can be a blend of helium and another inert gas such as argon. When helium is used in the tube reactor for the formation of titanium aluminides, the residence time of the powder at 1000° C. can be less than 3 minutes, while for Ti-6Al the inventors have measured residence times of around 6 minutes.

The process described herein has been shown to be capable of producing a wide range of Ti—Al based alloys, including titanium aluminides and low-Al content alloys. The composition of the required base alloy is determined by the relative amounts of aluminium and titanium chlorides in the starting materials. For titanium aluminides, the ratio is usually higher than the stoichiometric amount required for completion of the reaction in Step 2, and the associated process yield is typically above 90%, suggesting only minor losses of titanium chlorides. For production of alloys with a low Al content, there is usually an excess of titanium chlorides relative to Al. The subchloride is removed from the powder during processing, and requires collection and recycling adding to the production cost of the material.

Losses of titanium chlorides from the reaction in Step 1 can occur only in the form of titanium tetrachloride. As $TiCl_4$ condenses at room temperature, it is relatively easy to recycle as a part of the first reaction step. For the second step at high temperatures, losses may occur in two different ways: (i) subchloride powders carried in the gas stream and (ii) losses through formation of $TiCl_4$ due to decomposition of titanium subchlorides. The first loss factor can be minimised through the design of the reactor. The inventors have discovered that in using the reactor shown in FIG. 4 that losses of $TiCl_3$ are minimal as suggested by the physical appearance of the collected $AlCl_3$ by-products and by the measured yield of the process. Losses due to the escape of $TiCl_4$ can be somewhat more problematic as they may adsorb on the aluminium chlorides and separation of these two materials is somewhat difficult. The inventors have also found that low-temperature vacuum distillation of the $AlCl_3$ is capable of removing $TiCl_4$, but this can add to the production cost. The importance of this issue can only be estimated in relation to the intended use of the $AlCl_3$ by-products. For example, if the $AlCl_3$ is to be recycled to produce $TiCl_4$ as suggested in the process, then the problem outlined above is reduced to only minor losses of energy associated with the decomposition of titanium subchlorides in the high temperature reactor. The inventors have made theoretical calculations to suggest that: (1) at temperatures above 1000° C., chlorine-based compounds cannot exist in the solid phase, meaning that materials processed at 1000° C. should contain no residual chlorine, and (2) losses through formation of $TiCl_4$ are of the order of a few percent, and hence do not constitute a major loss factor.

FIGS. 5 and 6 show results for calculations of equilibrium composition made for titanium subchlorides in argon at 1 atm in the temperature range between 300K and 3000K. These figures show that solid compounds containing chlorine cannot exist in a solid phase at temperatures higher than 1300K (~1000° C.). It is seen in FIG. 4 that at temperatures above 1000K, solid $TiCl_3$ sublimes and partially decomposes into solid $TiCl_2$ and gaseous $TiCl_4$ in a ratio $TiCl_3(g):TiCl_2(s):TiCl_4(g)$ of 1:1:1. Also, it is seen in FIG. 6 that at temperatures higher than 1100K, solid $TiCl_2$ decomposes to form $TiCl_3$ (g) Ti (s), $TiCl_2$ (g) and $TiCl_4$(g) in a ratio of (58:34:4:3). For the reactor configuration considered in this specification, where inert gas flows in a direction opposite to the solid powder, gaseous chlorine-based compounds are carried with the gas flow away from the reaction zone, leaving chlorine-free powdered alloys of Ti—Al. Titanium subchlorides are condensed elsewhere in the reactor and reprocessed on line while $AlCl_3$ and $TiCl_4$ are driven out of the reactor into an appropriate collection unit. $TiCl_4$ resulting from decomposition of titanium subchlorides may react further react with Al powder fed into the reactor, and this may reduce the $TiCl_4$ amount escaping out the reactor.

In FIG. 7 the inventors present data for the equilibrium composition for a mixture of $TiCl_3$/Al in a ratio of 1 to 0.9 corresponding to 90% of stoichiometric requirements, suggesting that losses of $TiCl_4$ through decomposition of subchlorides is less than 1% of the starting $TiCl_3$. It is also seen that for this composition at a temperature of 1300K, 25% of the starting $TiCl_3$ still exists in the gas phase and, with the selected experimental conditions described herein, would be driven away from the reaction zone.

In FIG. 8 the inventors present results for calculations similar to those in FIG. 4 but with an Al/$TiCl_3$ ratio of 0.5 to 1, corresponding to 50% stoichiometric requirements. These results suggest that even for 50% stoichiometric ratio, losses of precursor materials through decomposition leading to $TiCl_4$ is less than 2% of the starting materials.

Investigations carried out in a batch made operation have shown that the amount of Al relative to $TiCl_3$ in the starting materials determines the composition of the end products obtained at the exit of Step 2 as illustrated by the results in FIG. 3. The results in FIG. 3 for Al powders less than 15 micrometers in size suggest that titanium alloys with a low Al content less than 6% per weight can be obtained only if the Al content in the starting materials was below 60% relative to normal stoichiometric conditions required for $TiCl_3$+Al+Ti+$AlCl_3$. The corresponding single-pass yield would then be around 50%. The excess $TiCl_3$ present in the starting materials needs to be collected and reprocessed. These figures can change depending on the morphology and size of the Al powder; for example, for aluminium flakes, the ratio [Al]/[$TiCl_3$] is around 80% with the yield is around 75%.

For the reactor configuration shown in FIG. 4, recycling of excess $TiCl_3$ makes it possible to produce alloys with an Al content less than 2 wt % and with a very high yield without need for recycling or disproportionating excess chlorides, as is known in the prior art. This makes the process capable of producing alloys with a very low Al content (below 2%) with single pass yield higher than 90%. It is also possible to produce titanium-aluminium compounds with a very low aluminium content (down to fractions of a percentage by weight). The reactor configuration shown in FIG. 4 permits the reaction between aluminium and a metal halide or subhalide to occur with the continual removal of the aluminium halide reaction product accompanied by the continual return of condensed metal halide or subhalide into the reaction zone. Effectively this means that, after a period of operation, the reaction zone can develop a high operational concentration of metal halide and sub-halide (either recycled or sourced from new feed material) and a relatively low level of aluminium and aluminium-containing species, whilst being driven in a forward direction by the continual removal of the aluminium halide reaction product. This can lead to the production of a metal compound or alloy having a generally very low aluminium content.

This is further illustrated in the following example: Starting materials: 127 cc of $TiCl_4$ and 37.2 g of Al flakes corresponding to 90% Al relative to the full stoichiometric amount required for $TiCl_4$+1.33Al→Ti+1.33 $AlCl_3$ and with 30 g of $AlCl_3$ as catalyst in Step 1. The $TiCl_4$—Al—$AlCl_3$ mixture was first heated to carry out Step 1 leading to $TiCl_3$+Al+$AlCl_3$ and then the resulting solid mixture was fed through the high temperature reactor as shown in FIG. 4. The single cycle time (time between moving the scrapers in the reactor) was fixed at 90 seconds for this experiment, corresponding to a total residence time of around 4-6 minutes in the region of the reactor at a temperature of 1000° C. (15 cm long section). The total amount of powder collected=42 g collected in three different samples. FIG. 9 shows XRD spectra for these samples. The subchlorides (most likely $TiCl_2$) remaining in the reactor at the end of the trial=10 g. The $AlCl_3$ by-products collected had a deep white colour suggesting no contamination with $TiCl_3$/$TiCl_2$.

FIG. 9 shows results of XRD spectra for Ti—Al samples collected at different times (i) immediately after the start in FIG. 9-*a*, (ii) mid-time during the trial in FIG. 9-*b* and (iii) towards the end of the trial in FIG. 9-*c*.

These Figures clearly show that the intensity of lines corresponding to Ti(Al) (Al dissolved within the Ti) increase relative to the lines corresponding to $Ti_3Al$, suggesting the Ti content in powder increases with time. These results are further confirmed by quantitative EDX analysis showing the Al content for materials corresponding to FIGS. 9-*a*, 9-*b* and 9-*c* to be 8.5%, 7% and 1.5% respectively. The results suggest that the ratio of Al to $TiCl_3$ decreases towards the end of the experiment in accordance with the results in FIG. 3, due to increased amounts of titanium subchlorides in the stream of titanium subchlorides-Al mixture progressing through the reactor. This can occur only if subchlorides evaporated from the high temperature zone towards the central region of the reactor are re-condensed as they pass through low temperature region in the direction of the gas exit.

Referring to FIG. 1 again, any aluminium trichloride (8) produced as a by-product of Step 2 can be used for other purposes. Part of the $AlCl_3$ can be used to catalyse the Step 1 reaction. Such a by-product can also be electrolysed to produce aluminium and chlorine (the aluminium may be fed back into Step 1). Advantageously, in accordance with an embodiment of the present invention, the aluminium trichloride can be recycled to produce titanium tetrachloride by reacting the $AlCl_3$ with the titanium ore (rutile or titanium oxide (9)), producing titanium tetrachloride (10) and aluminium oxide (13). The aluminium oxide produced by this process can be sold or electrolysed to produce aluminium raw material, which can be added to the feed materials in this process.

The methods described herein may also be used for production of metals and metal alloys by mixing metal halide or a mixture of metal halides (chlorides, bromides, iodides and fluorides) and carrying out the process as described hereinabove for the feed material $TiCl_4$. For example, zirconium and zirconium alloys may be produced using the same procedures described above for Ti and Ti-alloys respectively. For zirconium-based products, the starting material is zirconium chloride. Titanium metal can be produced by the above process following extensive recycling of titanium chlorides.

In still further embodiments, reducing agents other than aluminium which may be able to be used with a metal subhalide to produce a metal compound can include zinc, magnesium, sodium or other like metals.

The present method may be used for production of powders with a controlled particle size of various compositions including compounds of pure metal, oxides, nitrides of elements such as vanadium and zirconium, as described above for titanium.

Modifications and variations as would be apparent to a skilled addressee are deemed to be within the scope of the present invention.

The invention claimed is:

1. A stepwise method of producing titanium-aluminium compounds or alloys, comprising a first step of:

reducing an amount of titanium chloride ($TiCl_4$) with an amount of aluminium at a temperature below 160° C. to trigger reactions to form titanium subchloride(s) and aluminium chloride ($AlCl_3$) products in a first reaction zone, wherein before the reduction reactions commence, the aluminum is mixed with an amount of aluminum chloride ($AlCl_3$) which acts as a catalyst for the reaction between titanium chloride and aluminum;

and then a second step of:

mixing said products, with the addition of more aluminium if required, and heating the mixture in a second reaction zone to a temperature above 900° C. to form $AlCl_3$ in a gas phase, and to produce a reaction end product of the titanium-aluminium compounds or alloys.

2. A method as claimed in claim 1, wherein the first step is conducted with an excess amount of aluminium present to reduce all of the titanium chloride ($TiCl_4$) to form said titanium subchloride(s) and aluminium chloride ($AlCl_3$)products.

3. A method as claimed in claim 1, wherein titanium subchloride(s) and/or titanium chloride which escape(s) the first reaction zone is condensed at a temperature different to that in the reaction zone and returned to the first reaction zone.

4. A method as claimed in claim 1, wherein the second step is arranged for a generally continuous flow of solid feed reagent(s) and/or solids reaction end product(s) to cross through the second reaction zone.

5. A method as claimed in claim 1, wherein the second step is arranged for unidirectional movement of solids feed reagent(s) and/or solid reaction end product(s) through the second reaction zone, and arranged for passing a flow of an inert gaseous atmosphere through the second reaction zone in a direction that is opposite to the movement of solids feed reagent(s) and/or solid reaction end product(s).

6. A method as claimed in claim 1, also comprising the step of introducing a source of one or more elements.

7. A method as claimed in claim 6, wherein the or each element is selected from the group comprising chromium, niobium, vanadium, zirconium, silicon, boron, molybdenum, tantalum and carbon, and products of said method include titanium-aluminium compounds or alloys which include one or more of these elements.

8. A method as claimed in claim 1, wherein the aluminium is added in the form of a powder or flakes having an approximate upper size of less than about 50 micrometers in one dimension.

9. A method as claimed in claim 1, wherein the aluminium is in the form of a powder or flakes of an approximate upper size of greater than about 50 micrometers, and the method comprises the step of milling the aluminium powder or flakes to reduce the size of the aluminium powder or flakes in at least one dimension.

10. A method as claimed in claim 1, wherein the first step of reducing an amount of titanium chloride with an amount of aluminium to form titanium subchloride(s) and aluminium chloride products is at least partly conducted in a mill.

* * * * *